United States Patent [19]

Caus

[11] Patent Number: 4,534,217

[45] Date of Patent: Aug. 13, 1985

[54] MEASURING THE DRAFT OF A VESSEL

[75] Inventor: Frans Caus, Zeebrugee, Belgium

[73] Assignee: Tate & Lyle Public Limited Company, England

[21] Appl. No.: 568,402

[22] Filed: Jan. 5, 1984

[30] Foreign Application Priority Data

Jan. 7, 1983 [GB] United Kingdom ..... 8300332

[51] Int. Cl.[3] ..... G01C 21/00

[52] U.S. Cl. ..... 73/178 R; 73/302

[58] Field of Search ..... 73/302, 178 R, 65

[56] References Cited

U.S. PATENT DOCUMENTS

| | | | |
|---|---|---|---|
| 2,409,310 | 10/1946 | Piper | 73/302 |
| 3,334,608 | 8/1967 | Nemoto et al. | 73/65 |
| 3,396,470 | 8/1968 | Wood | 33/126.5 |
| 3,548,658 | 12/1970 | Lawes et al. | 73/302 |

FOREIGN PATENT DOCUMENTS

| | | |
|---|---|---|
| 466793 | 5/1914 | France . |
| 2250668 | 6/1975 | France . |
| 189991 | 12/1922 | United Kingdom . |
| 227797 | 1/1926 | United Kingdom . |
| 939326 | 10/1963 | United Kingdom . |

*Primary Examiner*—Donald O. Woodiel

*Attorney, Agent, or Firm*—Ostrolenk, Faber, Gerb & Soffen

[57] ABSTRACT

Apparatus has a closed, vented, damping chamber. A gas duct terminates in the damping chamber and air is bubbled through the gas duct. The pressure in the gas duct is read using a manometer, and indicates the distance below the water surface of the exit opening of the gas duct. The damping chamber is connected to the surrounding water by a water duct whose effective cross-sectional area is much less than that of the damping chamber.

11 Claims, 2 Drawing Figures

MEASURING THE DRAFT OF A VESSEL

BACKGROUND AND SUMMARY OF THE INVENTION

The present invention relates to apparatus for measuring the draft of a vessel, comprising a damping chamber for placing in the water in which the vessel is floating. The apparatus includes a gas duct for connection to a manometer, the gas duct having an exit opening below water level in communication with the damping chamber whereby gas can be passed through the gas duct to issue from the gas duct exit opening. The pressure of the gas in the gas duct is representative of the water pressure at the gas duct exit opening. The apparatus also includes a water duct for providing a connection between the damping chamber and the water in which the damping chamber is placed. The water duct has an effective cross-sectional area which is much less than the horizontal cross-sectional area of the damping chamber. The water duct is for admitting water to the damping chamber so that the water level in the damping chamber is above the gas duct exit opening, which water level will, in still conditions, correspond to that of the surrounding water.

The apparatus will be used to enable one to calculate the change in net weight of cargo in a vessel by noting the change in water level, i.e. draft or freeboard, during loading and unloading. At the present time, this is done by observing marks on the hull of the vessel, which is found to be relatively inaccurate; readings which are only slightly wrong can lead to a large miscalculation of cargo weight.

In general terms, it is desirable to provide an apparatus which gives readings which are not excessively influenced even by considerable wave action, which can provide more or less continuous readings at deck level, and which can be designed so as to be easy to handle from deck level.

In the present invention, a closed and vented damping chamber is used, connected to the surrounding water by a water duct having a much smaller effective cross-sectional area than the damping chamber; gas is bubbled from a gas duct terminating in the damping chamber—the pressure of the gas represents the depth of the gas duct exit opening.

British Pat. No. 939,326 discloses apparatus for measuring the draft of a vessel, having the gas duct and the manometer, but not having any damping chamber. In this case, the gas duct issues directly into the water. Although the disclosure recognizes the disturbance that can be caused by waves, the apparatus would be greatly influenced by waves and this would cause inaccurate readings to be taken.

British Pat. No. 189,991, French Pat. No. 466,795 and U.S. Pat. No. 3,396,470 disclose other apparatus which can be used for measuring the draft of vessels.

In general terms, it is desirable to provide an apparatus which gives readings which are not excessively influenced even by considerable wave action, which can provide more or less continuous readings at deck level, and which can be designed so as to be easy to handle from deck level.

Using the invention, the relative cross-sectional areas of the water duct and of the damping chamber enable an average water level to be maintained in the damping chamber, enabling more accurate readings to be taken of the draft or freeboard, from deck level. The damping chamber is suspended at a known distance from deck level and the average depth of immersion is measured by means of the manometer; the damping chamber can be raised or lowered to cross-check readings. Draft-marks on the hull of the ship are not required, and they were often inaccurate. Specifically, the apparatus of the invention compensates for wave action and good readings can be taken even with waves washing over the damping chamber, enabling the apparatus to be used at the quay-side, at anchor or in the open sea. Economically, this is of great importance as vessels can load to the maximum allowed freeboard without risk of overloading. The manometer can be a water manometer containing a sample of the water in which the vessel is floating, thereby compensating the apparatus for water density. As explained in more detail below, false readings due to tidal streams, river currents or water surges can also be reduced or avoided. Rolling of the vessel can be compensated for by averaging the two extremes (maximum level and minimum level).

The apparatus of the invention is easy to handle from the deck by day and night. Although the damping chamber is at sea level, the readings can be taken on deck or even in the ship's office, and it is easy to take cross-check readings and to take readings more or less continuously, as required. In addition, the apparatus can be portable and transported in hand luggage.

BRIEF DESCRIPTION OF THE DRAWINGS

The invention will be further described, by way of example, with reference to the accompanying drawing, in which.

DETAILED DESCRIPTION OF THE PREFERRED EMBODIMENTS

Figure 1:
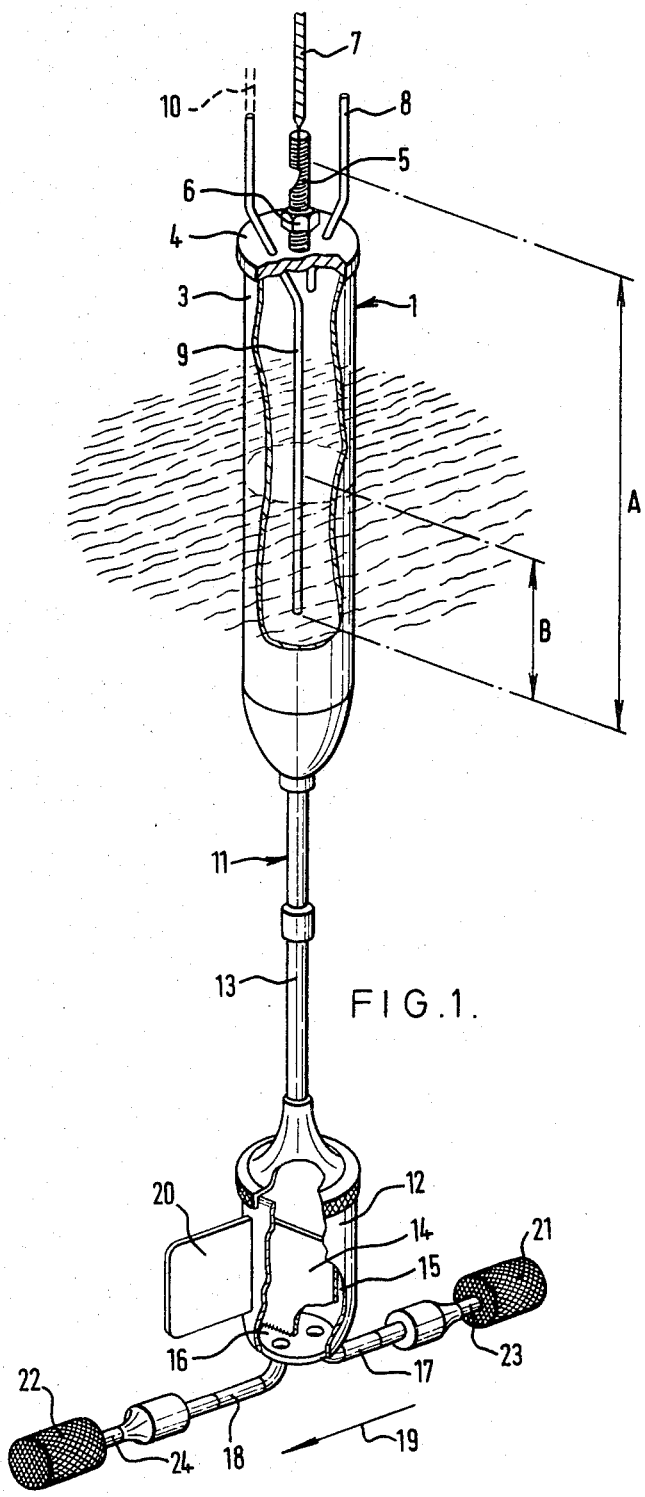
FIG. 1 is an isometric view, partly cut away, of part of apparatus in accordance with the invention.
Figure 2:
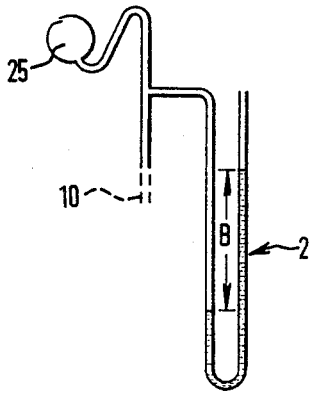
FIG. 2 is a schematic view of another part of the apparatus.

The apparatus comprises an instrument 1 which is placed in the water, as shown in FIG. 1, and a manometer 2, shown in FIG. 2. The instrument 1 has a substantially circular cylindrical (about a vertical axis), closed damping chamber 3 which is for placing in the water so that the average water level is at about half its height. The damping chamber 3 has a screwed-on top cap 4 to which is fitted supporting or suspending means in the form of a suspension hook 5 on a threaded stud carrying a locking nut 6 which prevents unhooking. The hook 5 is hooked on to the bottom of a suspension tape 7, graduated at, for instance, 10 cm intervals. The top of the suspension tape 7 is fitted to a fixed position on the vessel, preferably at deck level.

The cap 4 also carries a small cross-section vent 8 for venting gas from the damping chamber 3 and a rigid pipe or gas duct 9 to which is fitted a flexible plastic tube 10 connected to the manometer 2, e.g. at deck level or in the ship's office. If wave movement is excessive, the vent 8 can be extended upwards, for instance by a flexible plastic tube, to bring its upper end above the tops of the waves.

It will be noted that the lower end or exit opening of the gas duct 9 is within the damping chamber 3; in theory it need only be in communication with the damping chamber 3, provided it is subjected to the pressure of the water in the damping chamber 3.

A water duct 11 is furnished for providing a connection between the damping chamber 3 and the water in which the damping chamber 3 is immersed; the water duct 11 has an effective cross-sectional area which is much less than the horizontal cross-sectional area of the damping chamber 3. The water duct 11 admits water to the damping chamber 3 so that the water level in the damping chamber 3 is above the exit opening of the gas duct 9. As the damping chamber 3 is vented by the vent 8, the free water surface in the damping chamber 3 will, in still conditions, correspond to the water level of the surrounding water and, when there are waves, will correspond to the average level of the surrounding water, the efffect of wave motion being dampened by the reduced cross-sectional area of the water duct 11.

The water duct 11 projects downward below the damping chamber 3, being connected to the bottom of the damping chamber 3, and includes a substantially circular cylindrical (about a vertical axis) admission chamber or lower chamber 12 which is coaxial with the damping chamber 3. The admission chamber 12 is connected to the damping chamber 3 by one or more extension tubes 13 which ensure that the admission chamber 12 is maintained below water level, even when there is a large wave motion. The extension tubes 13 can be screw-threaded, for easy assembly.

The admission chamber 12 has a vertical separation member or plate 14 which extends for a substantial part of its height, dividing the respective part of the admission chamber 12 into an inlet zone 15 and an outlet zone 16. As shown, the damping chamber 3 is connected to the part of the admission chamber 12 above the separation plate 14; a water inlet 17 and a water outlet 18 lead to the bottoms of the inlet and outlet zones 15, 16 and open into the surrounding water at diametrically opposite positions. These positions are arranged to be upstream and downstream of the instrument 1 in the direction of current flow (indicated by the arrow 19) and face respectively upstream and downstream, so that water flows through the admission chamber 12 when there is a current (the separation plate 14 will be at right angles to the current). In order to achieve this, a vane or fixed rudder 20 is fixed to the admission chamber 12. In this way, the pressure effect of the incoming current is balanced by the suction effect of the outgoing current and the water level in the damping chamber 3 is more representative of the true water level.

The water inlet and outlet 17,18 are protected by fine strainers 21,22, and exchangeable restrictor orifices 23,24 are screwed in between the strainers 21,22 and the remainder of the inlet or outlet 17,18. The restrictor orifices 23,24 have the same cross-section, so that the effective cross-sectional areas of the inlet and outlet 17,18 are equal and are much smaller than the horizontal cross-sectional area of the admission chamber 12 and the flow cross-section in the admission chamber 12, thereby slowing down any flow in the admission chamber 12 and reducing any spurious pressure effects caused by flow.

The orifices 23,24 substantially determine the effective cross-sectional area of the whole water duct 11, and this is much less than the horizontal cross-sectional area of the damping chamber 3. If there is excessive wave motion, the restrictor orifices 23,24 can be exchanged for smaller orifices.

The manometer 2 is a normal water manometer, connected by means of a T to the flexible tube 10. A rubber bulb 25 with a one-way air valve is connected to the other limb of the T.

Operation

A sample of sea water is taken at the operating level of the instrument 1 and is used to fill the manometer 2. Providing the temperature remains the same, this ensures that the apparatus is corrected for any differences in specific gravity of the water in which the vessel is floating.

The instrument 1 is lowered to approximately the correct depth, and the height below deck level is noted from the graduations on the suspension tape 7.

Air pressure is then applied by very light manual operation of the rubber bulb 25. When the column of water in the manometer 2 does not rise any more, air will be bubbling slowly out of the exit orifice of the gas duct 9; the level difference B at the manometer 2 will be equal to the height B of the free water surface in the damping chamber 3 above the exit opening of the gas duct 9. The freeboard of the vessel will then be equal to the measurement on the suspension tape 7 plus a fixed dimension A less the measured height B.

It is intended that measurement should only be taken while the vessel is stationary, though, as explained above, there may be a current. The instrument 1 will not offer such resistance to the current, in relation to its weight, to swing it up to any noticeable degree.

Only one apparatus need be kept on the vessel or in the shore installation. Normally, readings will be taken on each side, forward, amidships and aft, i.e. six readings in all, from deck level. It is however possible to have e.g. two apparatus, one on each side amidships, connected by flexible plastics tubes 10 to respective side-by-side manometers 2 in the ship's office, enabling loading to be monitored from the ship's office. There is a well known formula for calculating the cargo loaded or discharged from the difference in readings which occurs during loading or discharge.

In one specific embodiment quoted by way of example, the gas duct 9 has an internal diameter of 3 mm, the damping chamber 3 has an internal diameter of 49 mm, the damping chamber 3 has a length (height) of 660 mm, the extension tubes 13 have an internal diameter of 7 mm, and two alternative restrictor orifices 23,24 are provided, having respective internal diameters of 2 mm and 4 mm. Using the 4 mm internal diameter restrictor orifices 23,24, the horizontal cross-sectional area of the damping chamber 3 is about 75 times the effective cross-sectional area of the water duct 11. Using the 2 mm internal diameter restrictor orifices 23, 24, the horizontal cross-sectional area of the damping chamber 3 is about 300 times the effective cross-sectional area of the water duct 11.

I claim:

1. Apparatus for measuring the draft of a vessel, comprising:

a closed damping chamber for being placed in the water in which the vessel is floating and for containing water having a free water surface inside the damping chamber, the free water surface having a level corresponding, in still conditions, to the level of the water in which the vessel is floating;

a gas duct for connecting to a manometer and having an exit opening below water level in communication with the damping chamber whereby gas can be passed through the gas duct to issue from the gas duct exit opening and the pressure of the gas in the gas duct is representative of the water pressure at the duct exit opening;

a vent for venting gas from the upper part of the damping chamber; and a water duct for providing a connection between the damping chamber and the water in which the damping chamber is placed, the water duct having an effective cross-sectional area which is much less than the horizontal cross-sectional area of the damping chamber, the water duct being for admitting water to the damping chamber so that the level of the free water surface is above the gas duct exit opening, wherein said water duct includes an admission chamber having a water inlet and a water outlet for opening into said surrounding water, the effective cross-sectional areas of said water inlet and of said water outlet to said admission chamber being equal and much smaller than the flow cross-section in said admission chamber.

2. The apparatus of claim 1, wherein the interior of said damping chamber is substantially cylindrical about a vertical axis.

3. The apparatus of claim 1, wherein the interior of said admission chamber is substantially circularly cylindrical about a vertical axis.

4. The apparatus of claim 1, wherein the water inlet and water outlet each have a respective open end, the respective open ends of said water inlet and of said water outlet facing respectively upstream and downstream, whereby water flows directly through said water inlet, through said admission chamber and through said water outlet when there is a current.

5. The apparatus of claim 4, having a vane fixed thereto, whereby said apparatus is brought into a predetermined alignment with said current and the positions at which the respective open ends of said water inlet and said water outlet open into said surrounding water are respectively upstream and downstream of said apparatus.

6. The apparatus of claim 1, wherein said admission chamber provides a non-linear path for water flowing therethrough from said water inlet to said water outlet.

7. The apparatus of claim 6, wherein said admission chamber has a first part and a second part, a separation member extending throughout said first part, dividing said first part into an inlet zone and an outlet zone, said water inlet and said water outlet leading to said inlet and outlet zones, respectively, and said damping chamber being connected to said second part of said admission chamber.

8. The apparatus of claim 1, wherein said water duct is connected to the bottom of said damping chamber, said water duct projecting downwards below said damping chamber.

9. Apparatus for measuring the draft of a vessel, comprising:

a closed damping chamber for being placed in the water in which the vessel is floating and for containing water having a free water surface inside the damping chamber, the free water surface having a level corresponding, in still conditions, to the level of the water in which the vessel is floating, said damping chamber being substantially circularly cylindrical about a vertical axis;

a gas duct for connection to a manometer and having an exit opening in said damping chamber whereby in use said exit opening will be below water level and the gas can be passed through said gas duct to issue from said gas duct exit opening, the pressure of said gas in said gas duct being representative of the water pressure at said gas duct exit opening;

a vent for venting gas from the upper part of the damping chamber;

a manometer connected to said gas duct, for sensing said pressure of said gas in said gas duct;

a water duct on said vertical axis, connected to the bottom of said damping chamber and projecting downwards below said damping chamber, said water duct having an effective cross-sectional area which is much less than the horizontal cross-sectional area of said damping chamber;

an admission chamber which is substantially circularly cylindrical about said vertical axis, and is connected to the lower end of said water duct, said admission chamber having a first, lower part and a second, upper part;

a separation member in said admission chamber extending for the whole vertical length of said first part, dividing said first part into an inlet zone and an outlet zone and thereby providing a non-linear path for water flowing through said admission chamber;

a water inlet connected to said inlet zone and a water outlet connected to said outlet zone, the effective cross-sectional areas of said water inlet and of said water outlet being equal and much similar than the flow cross-section in said inlet zone and said outlet zone in said admission chamber;

means for bringing said apparatus into a predetermined alignment with a current in said water surrounding said apparatus and for arranging the positions at which said water inlet and said water outlet open into said surrounding water to be respectively upstream and downstream of said apparatus in the direction of flow of said current, whereby water flows through said admission chamber when said current flows; and suspension means for suspending said damping chamber from said vessel in said water;

whereby the water level in said damping chamber substantially corresponds to that of said surrounding water and said pressure of said gas in said gas duct is a measure of said draft of said vessel.

10. A method of measuring the draft of a vessel, comprising placing in the water in which the vessel is floating apparatus comprising a closed damping chamber and a gas duct connected to a water manometer which is filled with a sample of said water in which said vessel is floating, and sensing the gas pressure in the gas duct when the gas issues from an exit opening of the gas duct, the gas duct exit opening being in communication with the damping chamber and the damping chamber being in communication with the water, the damping chamber being vented and there being a free water surface in the damping chamber, the effective cross-sectional area of the communication between the damping chamber and the surrounding water being much less than the cross-sectional area of the water surface within the damping chamber.

11. Apparatus for measuring the draft of a vessel, comprising:

a closed damping chamber for being placed in the water in which the vessel is floating and for containing water having a free water surface inside the damping chamber, the free water surface having a level corresponding, in still conditions, to the level of the water in which the vessel is floating;

a gas duct for connecting to a manometer and having an exit opening below water level in communication with the damping chamber whereby gas can be passed through the gas duct to issue from the gas duct exit opening and the pressure of the gas in the gas duct is representative of the water pressure at the duct exit opening;

a vent for venting gas from the upper part of the damping chamber; and a water duct for providing a connection between the damping chamber and the water in which the damping chamber is placed, the water duct having an effective cross-sectional area which is much less than the horizontal cross-sectional area of the damping chamber, the water duct being for admitting water to the damping chamber so that the level of the free water surface is above the gas duct exit opening, wherein the effective size of said water duct is determined by one or more exchangeable restrictor orifices therein.

* * * * *